US010539046B2

(12) United States Patent
Cecil

(10) Patent No.: US 10,539,046 B2
(45) Date of Patent: Jan. 21, 2020

(54) CAMSHAFT PHASER/COMPRESSION BRAKE RELEASE INTEGRATION WITH CONCENTRIC CAMSHAFT

(71) Applicant: Cummins Inc., Columbus, IN (US)

(72) Inventor: Adam C. Cecil, Columbus, IN (US)

(73) Assignee: Cummins Inc., Columbus, IN (US)

( * ) Notice: Subject to any disclaimer, the term of this patent is extended or adjusted under 35 U.S.C. 154(b) by 58 days.

(21) Appl. No.: 15/717,410

(22) Filed: Sep. 27, 2017

(65) Prior Publication Data

US 2018/0087410 A1 Mar. 29, 2018

Related U.S. Application Data

(60) Provisional application No. 62/400,256, filed on Sep. 27, 2016.

(51) Int. Cl.

| | |
|---|---|
| ***F01L 1/34*** | (2006.01) |
| ***F01L 1/047*** | (2006.01) |
| ***F01L 13/06*** | (2006.01) |
| *F01L 1/344* | (2006.01) |
| *F01L 13/00* | (2006.01) |

(52) U.S. Cl.

CPC ..... *F01L 1/047* (2013.01); *F01L 13/065* (2013.01); *F01L 2001/34423* (2013.01); *F01L 2013/0078* (2013.01)

(58) Field of Classification Search

CPC ..... F01L 1/267; F01L 2001/0473; F01L 2001/0475; F01L 2001/0476; F01L 2001/0535; F01L 2001/34423; F01L 2001/34433; F01L 2001/34453; F01L 2001/34479; F01L 2001/34493; F01L 2013/0078; F01L 2105/00; F01L 2820/031; F01L 1/047; F01L 13/065

See application file for complete search history.

(56) References Cited

U.S. PATENT DOCUMENTS

| | | | |
|---|---|---|---|
| 4,124,318 | A | 11/1978 | Sagady |
| 5,253,546 | A | 10/1993 | Elrod et al. |
| 6,405,696 | B1 | 6/2002 | Borraccia et al. |
| 7,540,267 | B1 | 6/2009 | Sellars |
| 7,895,979 | B2 | 3/2011 | Lancefield et al. |
| 8,113,158 | B2 | 2/2012 | Lancefiled et al. |
| 8,122,863 | B2 | 2/2012 | Myers |
| 8,667,939 | B2 | 3/2014 | Barnes et al. |
| 8,677,961 | B2 | 3/2014 | Fischer |
| 9,115,613 | B2 | 8/2015 | Deblaize |

(Continued)

FOREIGN PATENT DOCUMENTS

| | | |
|---|---|---|
| EP | 2079904 | 7/2009 |
| WO | 2015177127 | 11/2015 |

*Primary Examiner* — Zelalem Eshete

(74) *Attorney, Agent, or Firm* — Taft Stettinius & Hollister LLP

(57) ABSTRACT

Valve trains employing a splined interface between phaser(s) and a concentric camshaft, actuator at rear of camshaft actuated by an actuation rod, adding a clearance hole to the lobe pin for clearance to the actuation rod, supplying oil to camshaft bearings via the concentric camshaft inner tube, and bolt on front camshaft bearing. The valve trains may further employ a third rocker lever that is usable for a selectable valve event (e.g. compression release brake) while also implementing variable valve timing and a concentric camshaft.

30 Claims, 13 Drawing Sheets

(56) References Cited

U.S. PATENT DOCUMENTS

| | | | | |
|---|---|---|---|---|
| 9,222,375 | B2 | 12/2015 | Barnes et al. | |
| 2005/0045130 | A1* | 3/2005 | White | F01L 1/047 123/90.17 |
| 2010/0170458 | A1* | 7/2010 | Pluta | F01L 1/047 123/90.1 |
| 2014/0076252 | A1* | 3/2014 | Burke | F01L 1/352 123/90.17 |

* cited by examiner

CAMSHAFT PHASER/COMPRESSION BRAKE RELEASE INTEGRATION WITH CONCENTRIC CAMSHAFT

TECHNICAL FIELD

The present disclosure relates generally to concentric camshafts, and more particularly but not exclusively to integration of camshaft phaser and compression brake release with a concentric camshaft.

BACKGROUND

Camshaft phasers are common place in the light duty market, while only one application is present in the mid-range market. New methods for mounting a camshaft phaser onto a concentric camshaft are therefore needed.

Further, as fuel consumption and emissions requirements continue to reduce, optimizing the engine using fixed valve events is becoming increasingly more challenging. Having the ability to change valve timing has proven to be an effective lever for after treatment thermal management. Utilizing variable valve timing (VVT) is also a low cost alternative to more elaborate variable valve actuation (VVA) strategies. Midrange applications also need to have a compression release brake in conjunction with VVT technology.

SUMMARY

The present disclosure describes a splined interface between phaser(s) and a concentric camshaft, actuator at rear of camshaft actuated by an actuation rod, adding a clearance hole to the lobe pin for clearance to the actuation rod, supplying oil to camshaft bearings via the concentric camshaft inner tube, and bolt on front camshaft bearing.

The present disclosure further describes a third rocker lever that is usable for a selectable valve event (e.g. compression release brake) while also implementing VVT and a concentric camshaft.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION OF ILLUSTRATIVE EMBODIMENTS

Figure 1:
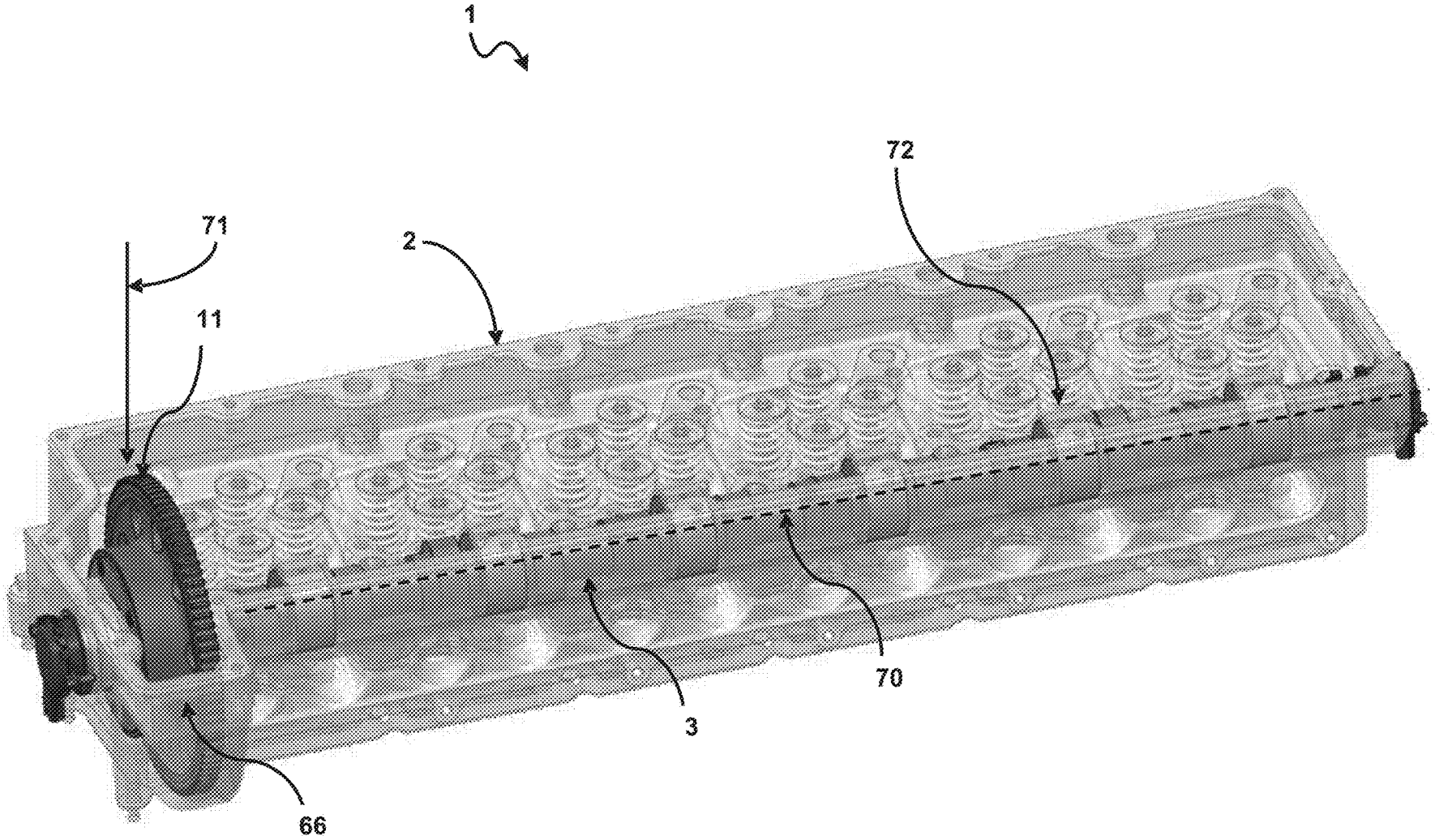
FIG. 1 is an isometric view of a cylinder head assembly of the present disclosure with a concentric camshaft.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

The present disclosure is applicable to an integration of a camshaft into a cylinder head. Specifically, the lowest cost way to integrate a camshaft into a cylinder head is by utilizing a feed through approach. The camshaft is fitted into one end of the cylinder head and then assembled through the associated camshaft bearings one by one. This process eliminates the need for camshaft caps and their associated added cost and complexity. However, fixing a gear to this camshaft arrangement becomes challenging without introducing added cost and complexity with additional housings and sealing challenges. Implementing a camshaft phaser on a concentric camshaft creates even more difficulty. The present disclosure illustrates a cost effective way of integrating a camshaft phaser onto a concentric camshaft that utilizes a feed through bearing system.

With reference to FIG. 1, a cylinder head assembly 1 contains a cylinder head 2 and a concentric camshaft 3. The concentric camshaft 3 is assembled into the cylinder head 2 by pushing the concentric camshaft 3 through the camshaft bearings 72 located in the cylinder head 2 along the camshaft bore axis 70. Once the concentric camshaft 3 is installed, a concentric camshaft phaser 11 is vertically lowered 71 into the cylinder head 2 within slot 66. The concentric camshaft 3 is then shifted forward to engage with the phaser 11 as depicted in FIGS. 2-11.

Figure 2:
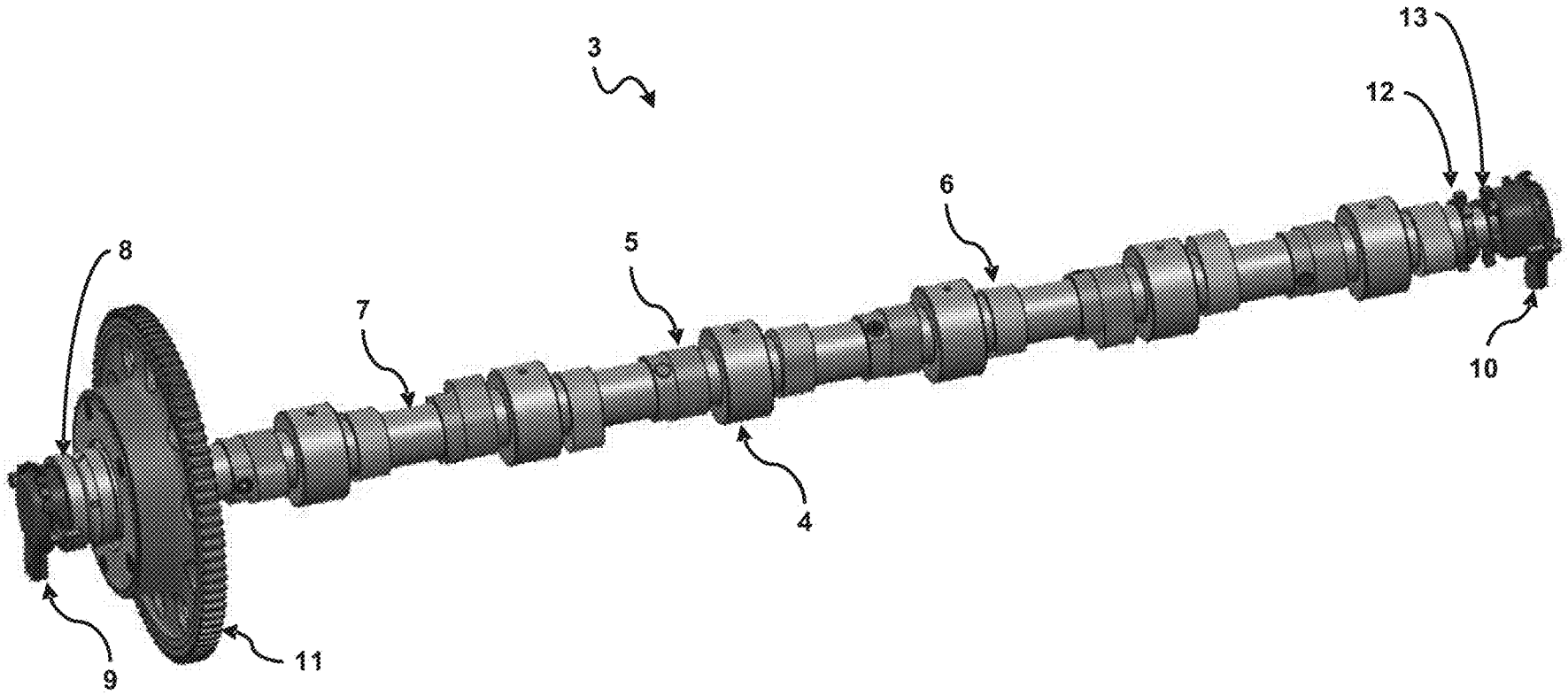
FIG. 2 is an isometric view of a concentric camshaft assembly of the present disclosure.

With reference to FIG. 2, the concentric camshaft assembly 3 is constructed of several assembled components including; concentric camshaft phaser assembly 11, standard camshaft bearings 4, intake camshaft lobes 6, exhaust camshaft lobes 5, an outer tube 7, front camshaft bearing 8, intake camshaft position sensor target wheel 12, and exhaust camshaft position sensor target wheel 13. A phase angle of the exhaust camshaft lobe 5 is adjusted with a actuator 9. A phase angle of the intake camshaft lobe 6 is also adjusted with a actuator 10.

Figure 3B:
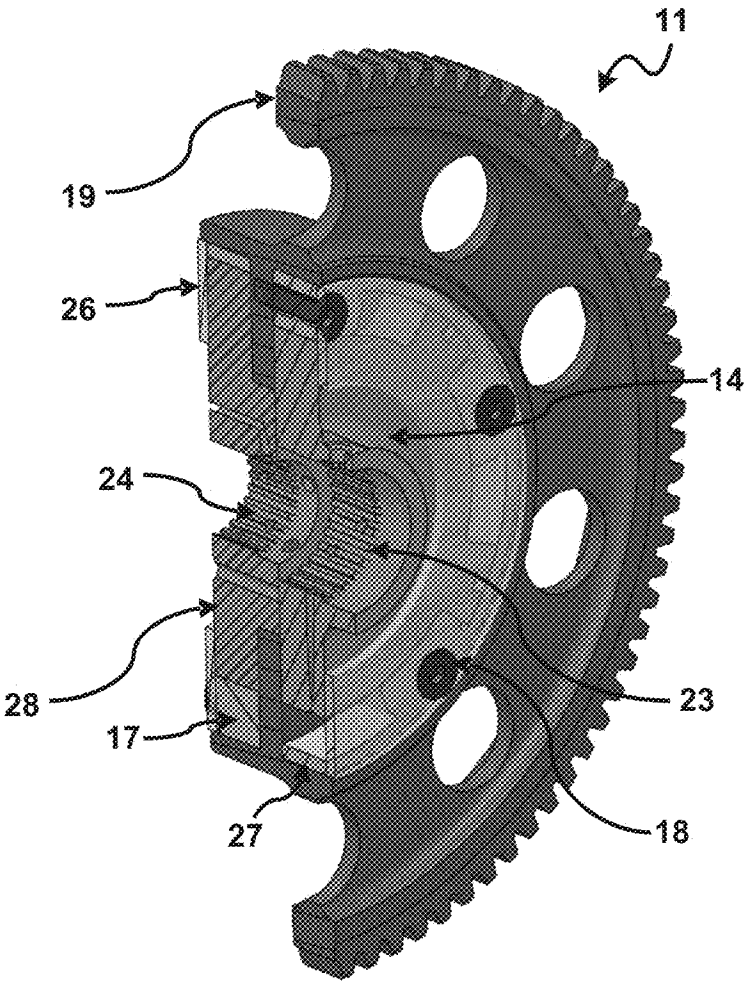
FIGS. 3*a* and 3*b* are cross-sectional views of a concentric camshaft phaser assembly of the present disclosure.
Figure 3A:
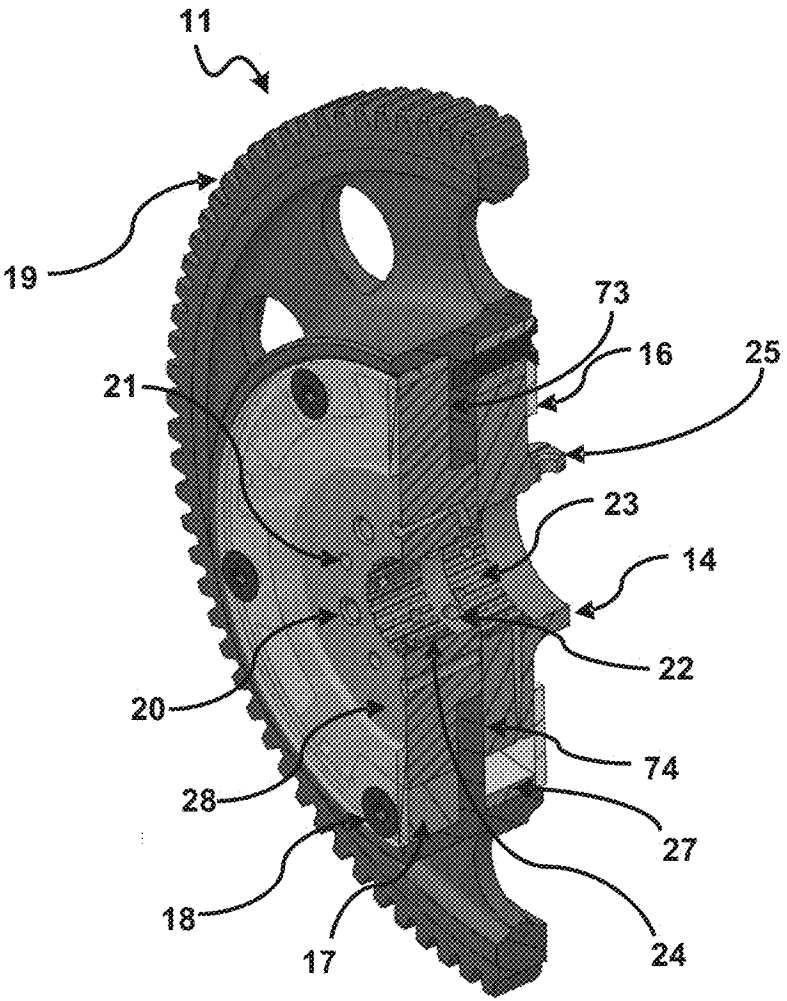

FIG. 3 illustrates the internal components of the concentric camshaft phaser 11. Referring to FIG. 3, a concentric camshaft drive gear 19 is connected to the engines crankshaft (not shown) and is driven at a specified and constant drive ratio. The concentric camshaft drive gear 19 also serves as the housing for the exhaust camshaft phaser vane cavity 17 and the intake camshaft phaser vane cavity 27. The phaser vane cavities 17, 27 are attached to the concentric camshaft drive gear via cap screws 18. The exhaust camshaft phaser vane plate 28 can rotate independently of the concentric camshaft drive gear 19 within the limits of the exhaust camshaft phaser vane cavity 17 and is secured axially by the concentric camshaft drive gear surface 73 and the exhaust camshaft phaser cover plate 26. The intake camshaft phaser vane plate 14 can rotate independently of the concentric camshaft drive gear 19 within the limits of the intake camshaft phaser vane cavity 27 and is secured axially by the concentric camshaft drive gear surface 74 and the exhaust camshaft phaser cover plate 16. Both the exhaust camshaft phaser cover plate 26 and the intake camshaft cover plate 16 are secured using the same cap screws 18 as the phaser vane cavities 17, 27. Splines 24 are located on the exhaust camshaft phaser vane plate 28 that engage with the inner tube of the concentric camshaft described later. Splines 23 are located on the intake camshaft phaser vane plate 14 that engage with the outer tube 7 of the concentric camshaft. Bolt locations 20 in the exhaust phaser vane plate 28 are used to secure the front camshaft bearing 8. The front camshaft bearing 8 provides a path for pressurized lube oil to enter the phaser assembly through oil holes 21 in the exhaust phaser vane plate 28 which connect to an intersecting oil hole 22. A phaser anti-thrust pin bore 25 is located on the rear of the intake camshaft phaser vane plate 14 and will be described later.

Figure 4B:
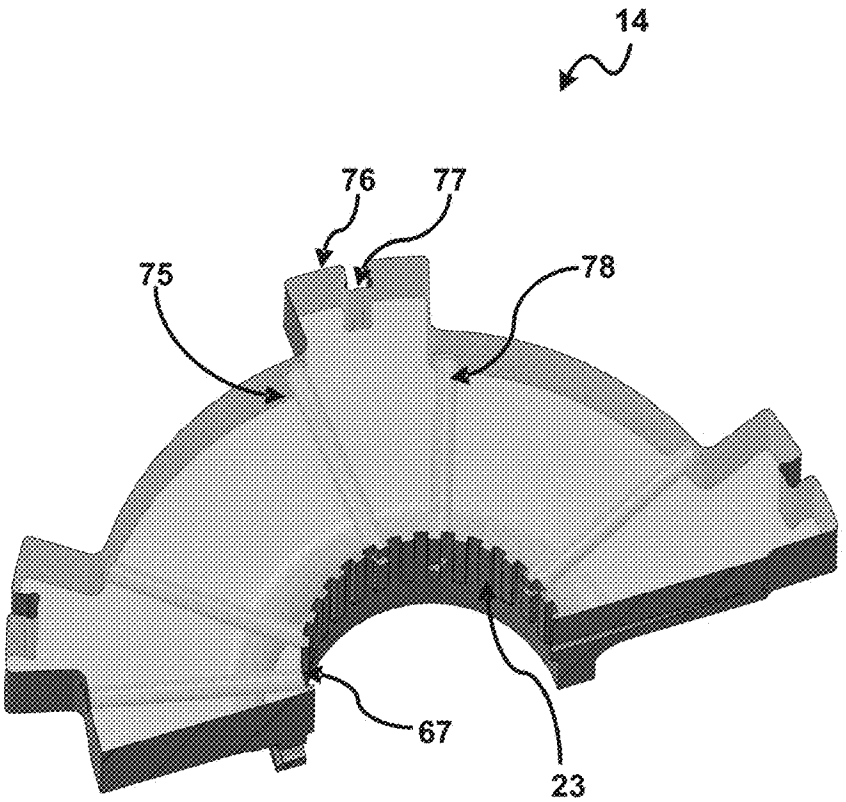
FIGS. 4*a* and 4*b* are cross-sectional view of a concentric camshaft phaser vane plates of the present disclosure.
Figure 4A:
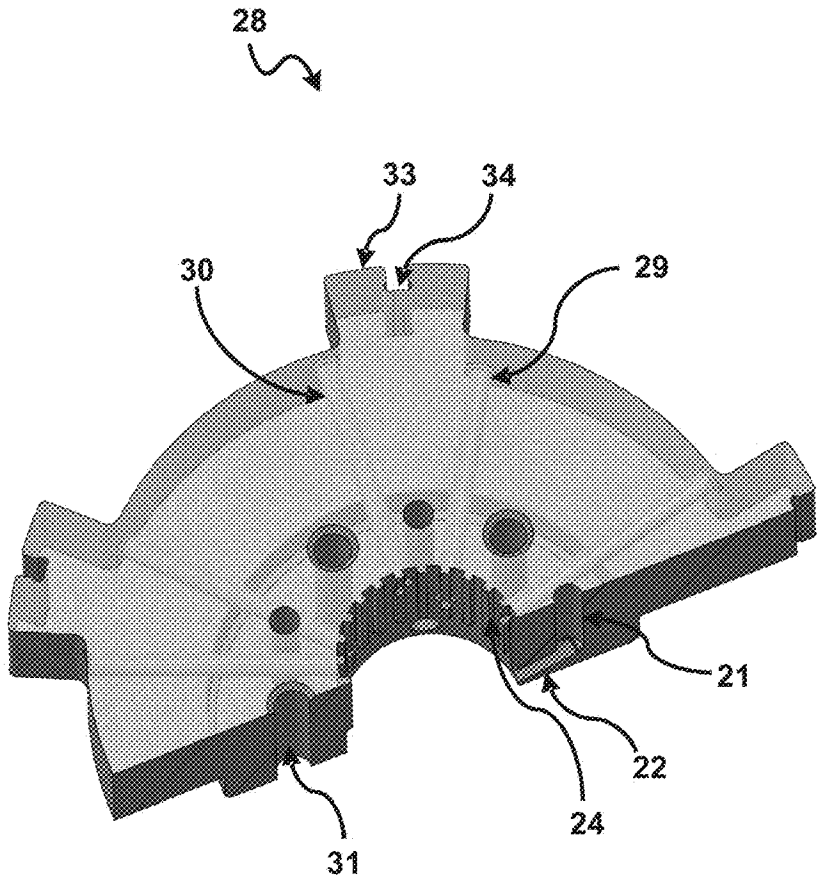

FIG. 4 provides a cross section view of both the exhaust phaser vane plate 28 and the intake phaser vane plate 14. The exhaust phaser vane 33 and the intake phaser vane 76 contain a phaser seal groove 34, 77 that houses a phaser seal not shown that isolates the advance and retard chambers of the phaser assembly. Pressurized lube oil can be regulated between the advanced chamber supply drillings 30, 75 and the retard chamber supply drillings 29, 78 via hydraulic cartridge shuttle valves depicted later. A discontinuity 67 in the intake camshaft phaser vane plate splines 23 allows for the concentric camshaft phaser assembly 11 to be timed correctly with the engine's mating gear train. This feature is also present in the exhaust camshaft phaser vane plate 28 but is hidden in this particular cross section.

Figure 5:
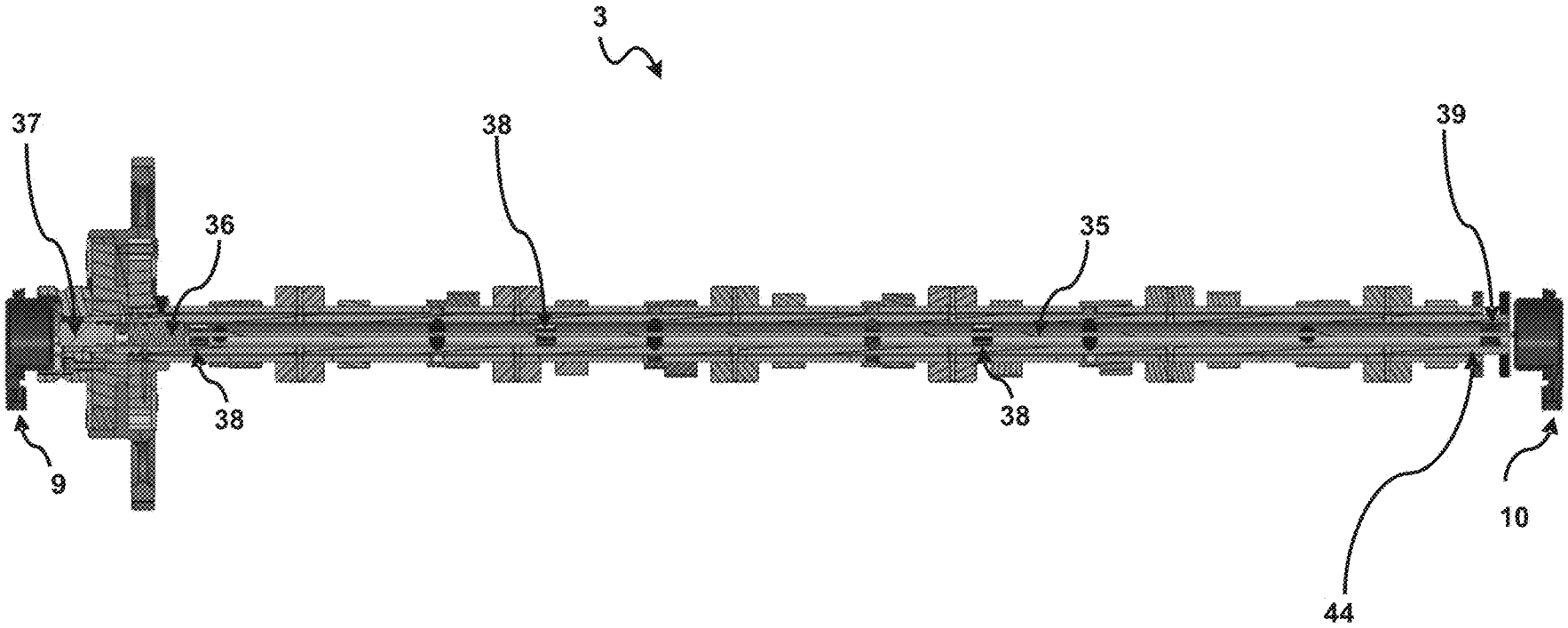
FIG. 5 is a cross-sectional view of a concentric camshaft assembly of the present disclosure.

FIG. 5 illustrates a cross section through the concentric camshaft assembly 3 along the camshaft axis. The concentric camshaft assembly is further constructed with; an exhaust phaser hydraulic cartridge shuttle valve 37, an intake phaser hydraulic cartridge shuttle valve 36, an intake phaser hydraulic cartridge shuttle valve actuation rod 35, intake phaser hydraulic cartridge shuttle valve actuation rod guides 38, and an intake phaser hydraulic cartridge shuttle valve actuation rod guide and seal combination 39. The seal is required to keep pressurized lube oil from escaping the inner tube and instead provide lube oil to the standard camshaft bearings 4 as described later. Likewise seal ring 44*a*-44*c* are present between the outer tube 7 and the inner tube 41 to seal the pressurized oil from escaping between the outer tube 7 and the inner tube 41.

Figure 6:
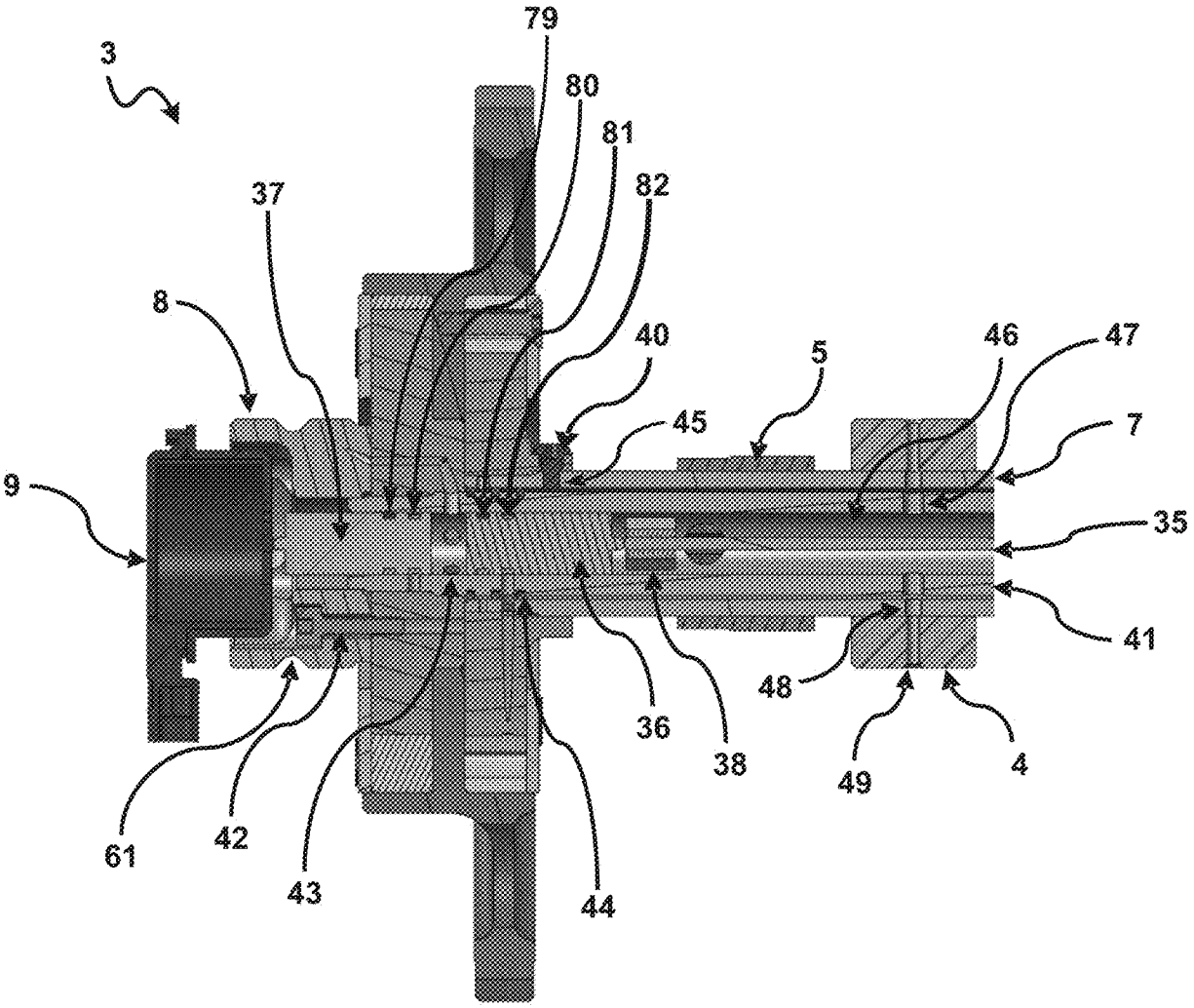
FIG. 6 is a detailed cross-sectional view of a concentric camshaft assembly of the present disclosure.

FIG. 6 shows the concentric camshaft phaser assembly 11 assembled to the concentric camshaft. Pressurized lube oil is supplied to the front camshaft bearing 8 via a groove 61. Through channels described previously the pressurized lube oil enters the chamber 43 formed between the exhaust phaser hydraulic cartridge shuttle valve 37 and the intake phaser hydraulic cartridge shuttle valve 36. Oil is then metered to the advanced and retard channels of the phaser vane plates via grooves 79, 80, 81, 82 by the axial movement of the actuators 9, 10. Seal rings 44*a*-44*c* are present between the outer tube 7 and the inner tube 41 to seal the pressurized oil as it transitions to the intake phaser vane plate 14. Pressurized oil from a second source is also used to supply lube oil to the camshaft bearings 4 by passing oil through the inner diameter of the inner shaft 41. Pressurized oil enters the camshaft via a drilling 49 and passes through an associated drilling 48 and 47 to enter the inner diameter of the inner tube 41. Oil then travels to the remaining camshaft bearings and exits the camshaft along a similar path. The front camshaft bearing 8 is attached to the exhaust camshaft phaser vane plate with cap screws 42. A phaser anti-thrust pin 40 prevents axial movement of the phaser assembly 11 by engaging an associated anti-thrust hole 45 in the concentric camshaft outer tube 7.

Figure 7:
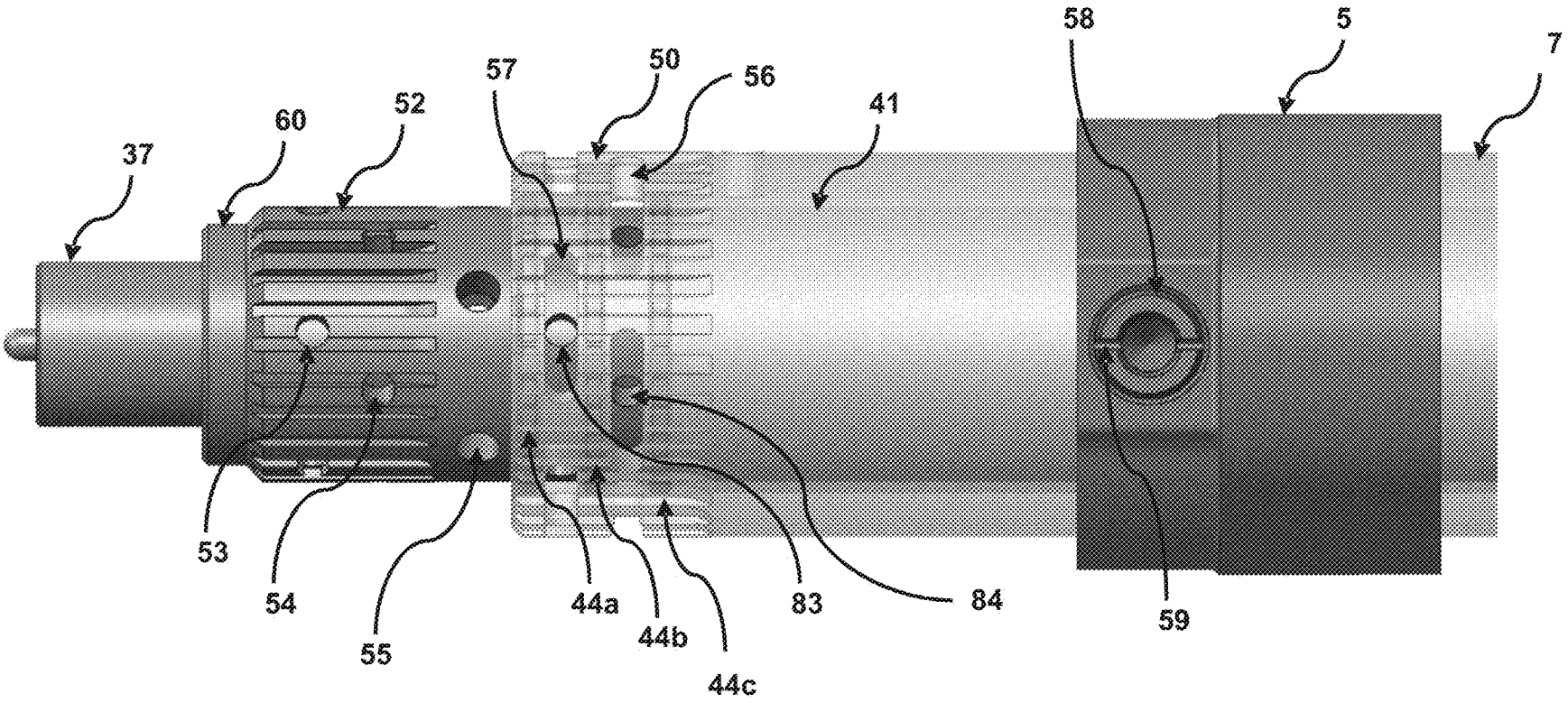
FIG. 7 is a detailed side view of a concentric camshaft nose of the present disclosure.

FIG. 7 depicts the nose of the concentric camshaft phaser. The exhaust camshaft phaser vane plate advance and retard drillings 53, 54 are present in the inner tube 41. The intake camshaft phaser vane plate advanced and retard drillings 83, 84 are also located in the inner tube 41. The intake camshaft phaser vane plate advanced and retard slots 56, 57 are present in the outer tube 7. The slots 56, 57 ensure that the advanced and retard drillings 75, 78 in the intake camshaft phaser vane plate 14 remain in constant communication with the intake phaser hydraulic cartridge shuttle valve 36 regardless of the phase angle of the exhaust phaser vane plate 28. Splines 52 engage with the exhaust camshaft phaser vane plate splines 24 while splines 50 engage with the intake phaser vane plate splines 23. This allows the phaser vane plate motion to be transferred into the outer tube 7 and inner shaft 41. A pilot diameter 60 is also shown to accurately locate the front camshaft bearing 8 with respect to the camshaft axis.

Figure 8:
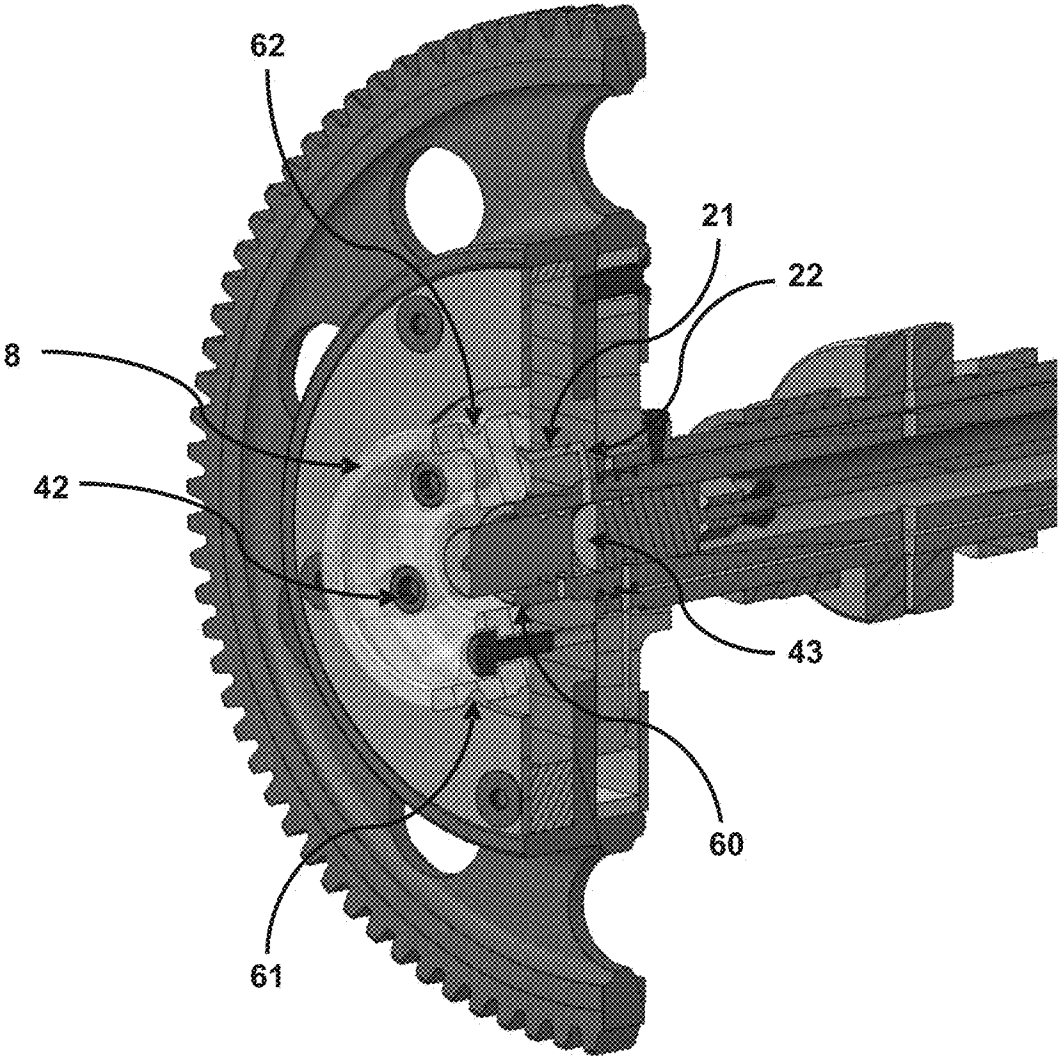
FIG. 8 is a detailed cross-sectional view of a front camshaft bearing of the present disclosure.

FIG. 8 shows the front camshaft bearing 8 fixture details and illustrates the oil supply drilling 62 that connects the oil supply groove 61 with the exhaust camshaft phaser vane plate oil transfer hole 21.

Figure 9:
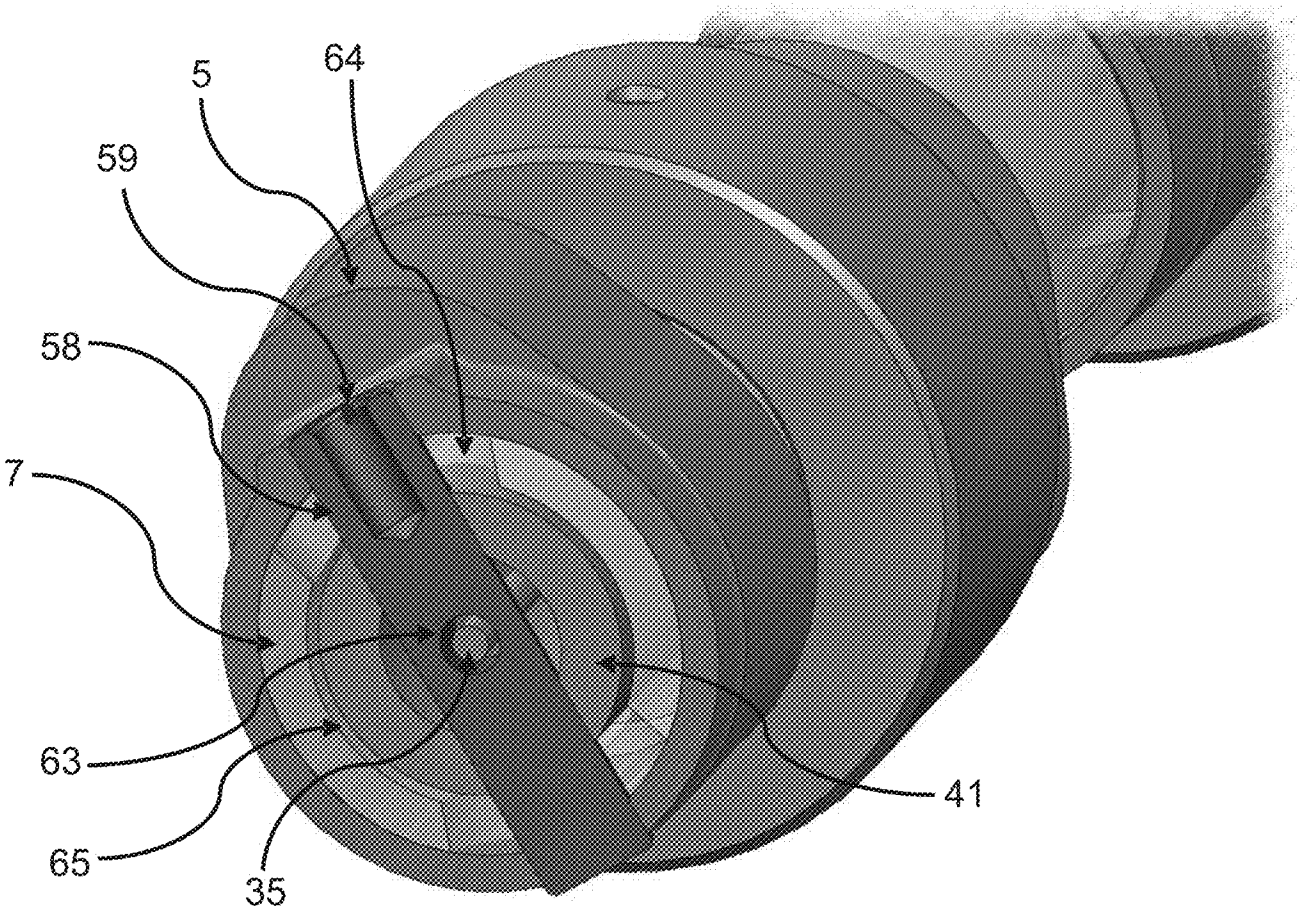
FIG. 9 is a detailed view of a concentric camshaft exhaust lobe of the present disclosure.

FIG. 9 illustrates a cross section through the concentric camshaft depicting the exhaust lobe connection pin 58. A hole 63 is located in the exhaust lobe connection pin 58 to allow the intake phaser hydraulic cartridge shuttle valve actuation rod 35 to pass through. A slot 64 is located in the outer tube 7 to allow the exhaust camshaft lobe 5 to phase independently of the outer tube 7. A gap 65 is present between the outer tube 7 and the inner tube 41 to allow the tubes to rotate freely with respect to one another. An assembly mark 59 which is also shown in FIG. 8 is used to ensure the exhaust lobe connection pin is oriented correctly during the manufacturing process to ensure that the intake phaser hydraulic cartridge shuttle valve actuation rod 35 will pass through the entire assembly.

Figure 10:
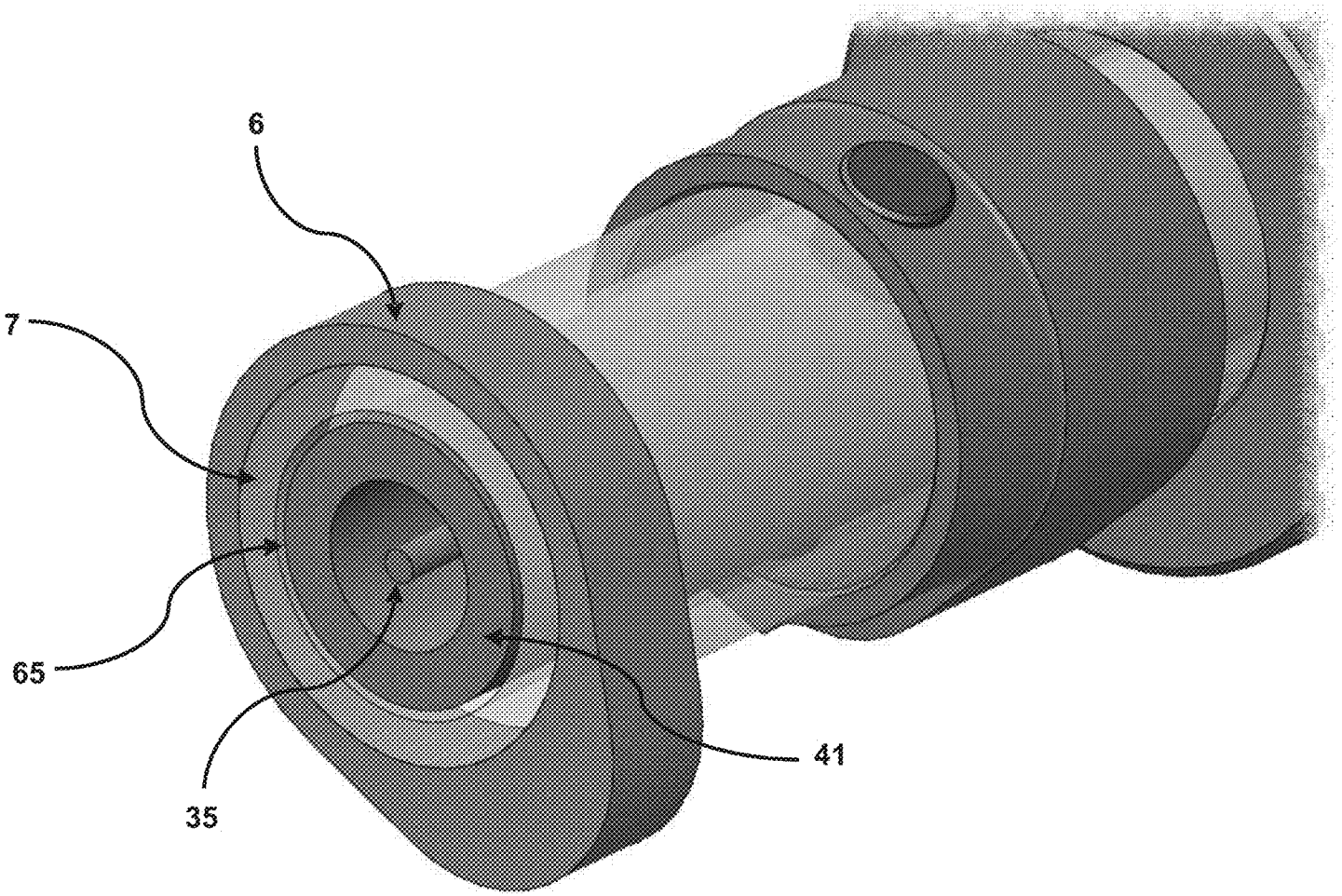
FIG. 10 is a detailed view of a concentric camshaft intake lobe of the present disclosure.

FIG. 10 illustrates a cross section through the concentric camshaft depicting the intake lobe 6 which is connected directly and "fixed" to the outer tube 7.

Figure 11:
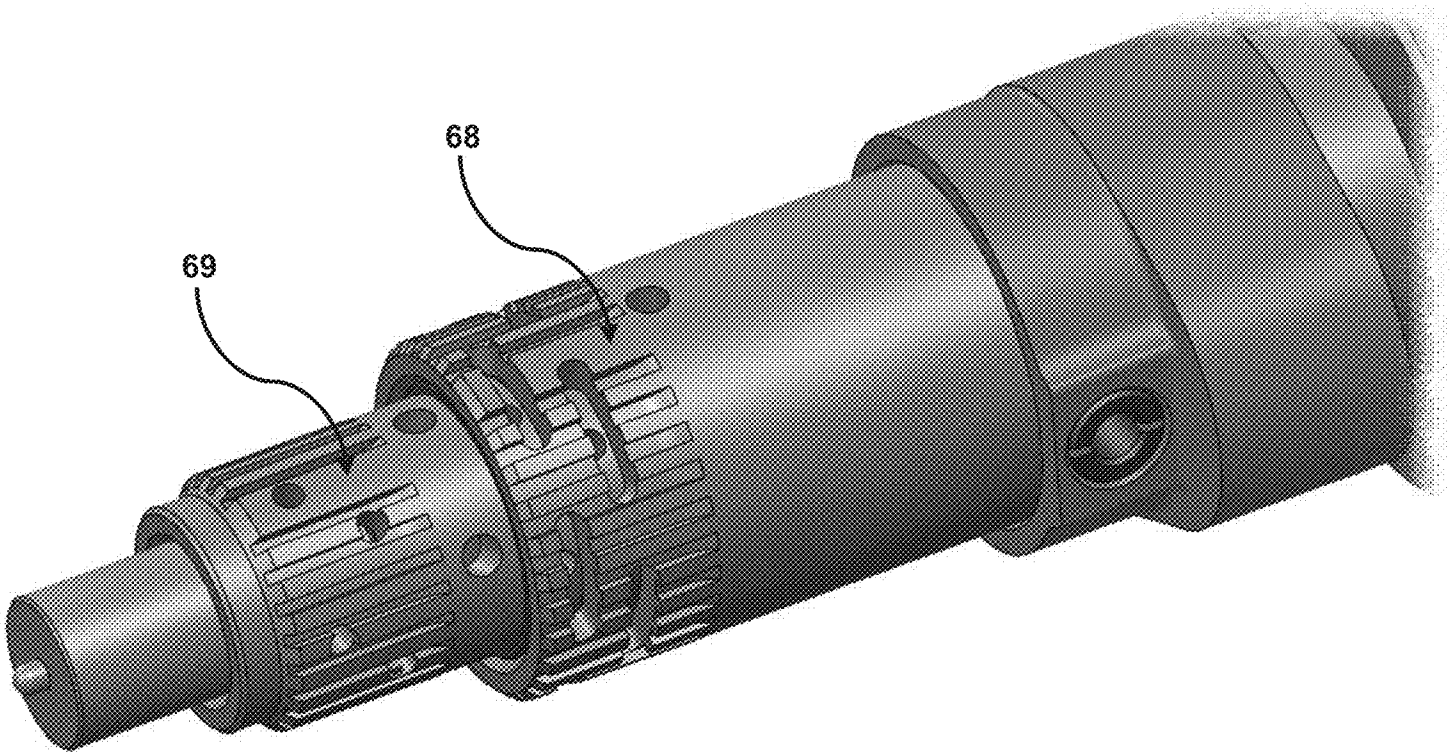
FIG. 11 is a detailed view of a concentric camshaft nose detail of the present disclosure.

FIG. 11 illustrates the discontinuous spline 69, 68 details located in the inner tube and the outer shaft respectively. This feature is used to correctly time the camshaft phaser assembly 11 with the concentric camshaft.

The present disclosure is also applicable to compression release brake in conjunction with a VVT technology. Specifically, the present disclosure describes a compression brake lobe on a concentric camshaft outer tube that has a fixed phase angle, pinning the camshaft phaser with a lock pin during compression brake operation.

Figure 12:
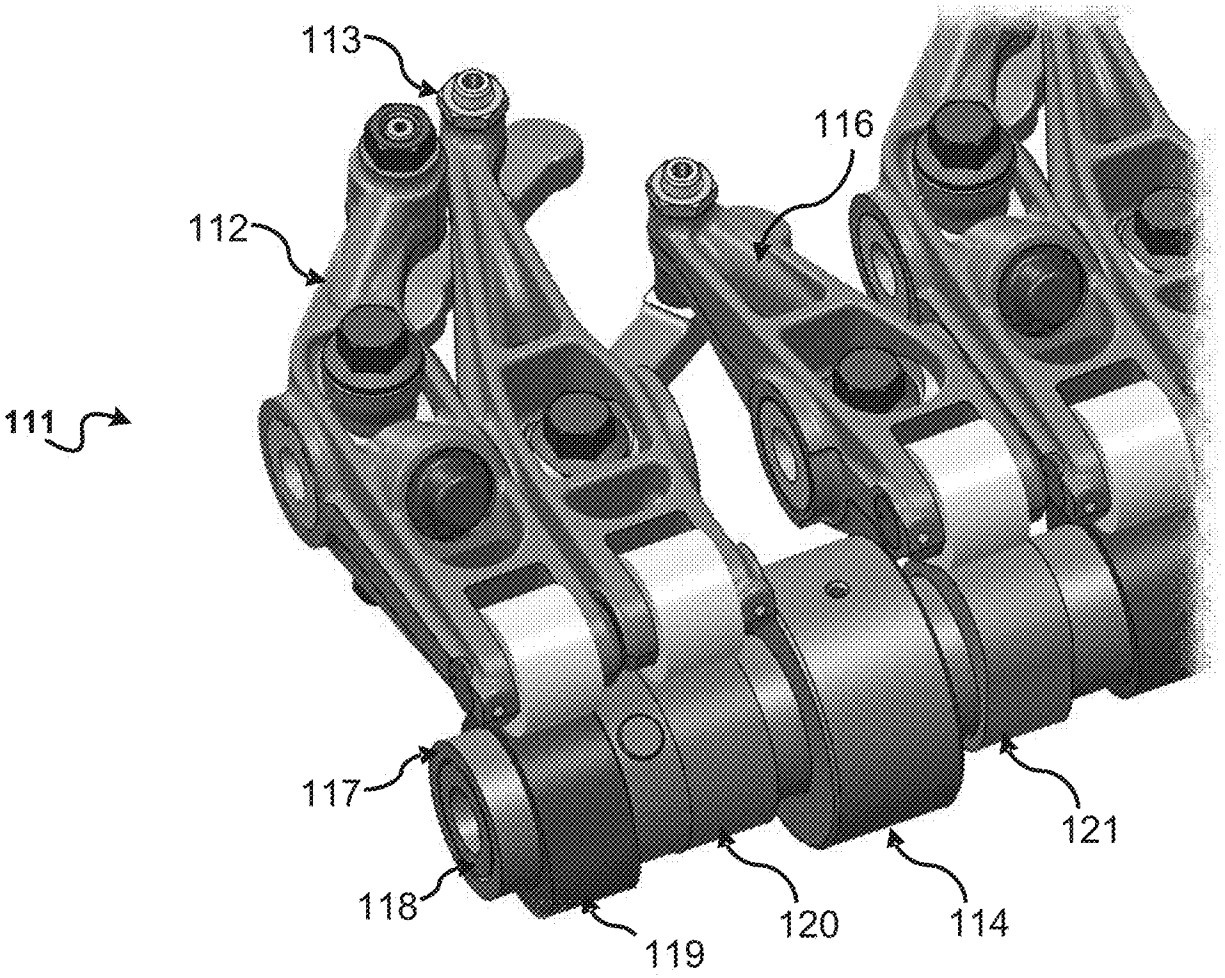
FIG. 12 is an isometric view of a valve train assembly of the present disclosure with a brake rocker lever and a concentric camshaft.

As depicted in FIG. 12, a valve train assembly 111 utilizes a concentric camshaft constructed of intake camshaft lobe(s) 121, exhaust camshaft lobe(s) 120, dedicated compression release brake lobe(s) 119, camshaft bearings 114, an outer tube 117 and a shaft 118. The intake rocker lever(s) 116 follow the intake camshaft lobe(s) 121, the exhaust rocker lever(s) 113 follow the exhaust camshaft lobe 120, and the dedicated compression release brake lever(s) 112 follow the dedicated compression release brake lobe(s) 119. The rocker levers actuate the intake and exhaust valves not shown accordingly. An exhaust camshaft phaser not shown is used to control the phase angle of the exhaust camshaft lobes(s) 120 independently of the intake camshaft lobe(s) 121 and the dedicated compression release brake lobe(s) 119. The intake camshaft lobe(s) 121 and the dedicated compression release brake lobe(s) 119 are not phased and remain in sync with the engine's traditional camshaft drive mechanism. Described another way, the outer tube 117 is at a fixed and constant phase angle with the engine's traditional camshaft drive mechanism while the inner shaft 8 can vary in phase angle with respect to the engine's traditional camshaft drive mechanism.

Figure 13:
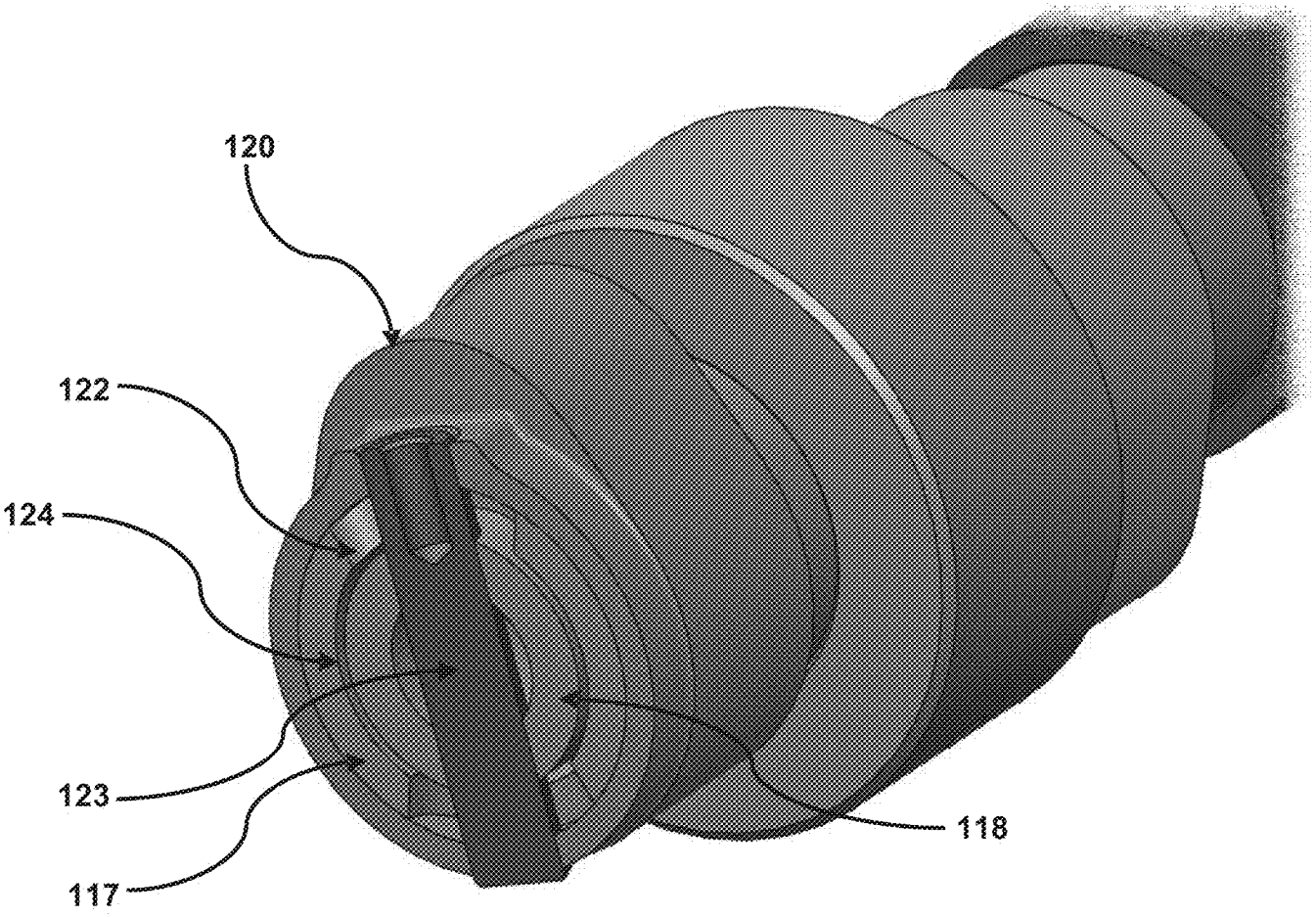
FIG. 13 is an isometric cross-sectional view of a concentric camshaft exhaust lobe of the present disclosure.

FIG. 13 illustrates a cross section through the concentric camshaft depicting the exhaust lobe connection pin 123. A slot 122 is located in the outer tube 117 to allow the exhaust camshaft lobe 120 to phase independently of the outer tube 117. A gap 124 is present between the outer tube 117 and the inner shaft 8 to allow the tubes to rotate freely with respect to one another. The intake camshaft lobe(s) 121 and the dedicated compression release brake lobe(s) 119 connected directly and "fixed" to the outer tube 117. The pin 123 is an interference fit with the exhaust camshaft lobe(s) 120 and the inner shaft 118.

Although not shown with graphics should a camshaft phaser be used on the shaft or tube that connects to the dedicated compression brake lobe(s) 119 it could be necessary to pin the camshaft phaser during compression release brake operation due to high camshaft drive torques. While camshaft phasers implemented today have locking pins this particular locking arrangement would be "engaged on demand" during compression release brake mode rather than during startup/shutdown conditions which is typical today.

As is evident from the Figs and text presented above, a variety of aspects of the present invention are contemplated.

According to one aspect, a splined interface is provided between phaser(s) and concentric camshaft.

According to another aspect, an inner shaft may be entirely or partially hollow, or solid.

According to another aspect, an actuator is located at rear of camshaft and applies axial movement through an actuation rod.

According to another aspect, a clearance hole is added to the lobe pin for clearance to the actuation rod.

According to another aspect, oil is supplied to camshaft bearings via the concentric camshaft inner tube and bolt on front camshaft bearing.

According to another aspect, although the present disclosure is illustrated with both intake and exhaust phasers, the design is still relevant if only one of the phasers is implemented.

According to another aspect, the intake and exhaust lobes could also be swapped and maintain the same functionality.

According to another aspect, the hole in the lobe pin could also be used to guide the actuation rod instead of the dedicated guide spacers depicted in this disclosure.

According to another aspect, a compression brake lobe on a concentric camshaft outer tube that has a fixed phase angle, pinning the camshaft phase with a lock pin during compression brake operation.

In one embodiment, a valve train comprises a concentric camshaft including an outer tube, and an inner shaft extending within the outer tube. The valve train further comprises a phaser including an intake camshaft phaser vane cavity, an intake camshaft phaser vane plate independently rotatable within the intake camshaft phaser vane cavity, an exhaust camshaft phase vane cavity, and an exhaust camshaft phaser vane plate independently rotatable within the exhaust camshaft phaser vane cavity. The intake camshaft phaser vane plate includes splines engaging the outer tube of the concentric camshaft, and the exhaust camshaft phaser vane plate includes splines engaging the inner shaft of the concentric camshaft.

In a second embodiment, a valve train comprises a concentric camshaft including an outer tube, and an inner shaft extending within the outer tube. The valve train further comprises a phaser including an intake camshaft phaser vane cavity, an intake camshaft phaser vane independently rotatable within the intake camshaft phaser vane cavity, an exhaust camshaft phase vane cavity, and an exhaust camshaft phaser vane independently rotatable within the exhaust camshaft phaser vane cavity. The intake camshaft phaser vane includes splines engaging the inner shaft of the concentric camshaft, and the exhaust camshaft phaser vane includes splines engaging the outer tube of the concentric camshaft.

In a third embodiment, a valve train comprises a concentric camshaft including an outer tube having a slot and an inner shaft extending within the outer tube. The valve train further comprises an intake camshaft lobe connected to the outer tube, a dedicated compression release brake lobe connected to the outer tube, and an exhaust camshaft lobe connected to the inner shaft by an exhaust lobe connection pin extending through the slot of the outer tube whereby the exhaust camshaft lobe phases independently of the outer tube.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A valve train, comprising:

a concentric camshaft including:

an outer tube; and an inner shaft extending within the outer tube;

a phaser including:

an intake camshaft phaser vane cavity within the phaser;

an intake camshaft phaser vane plate independently rotatable within the intake camshaft phaser vane cavity;

an exhaust camshaft phase vane cavity within the phaser; and an exhaust camshaft phaser vane plate independently rotatable within the exhaust camshaft phaser vane cavity;

wherein the intake camshaft phaser vane plate includes splines engaging the outer tube of the concentric camshaft; and wherein the exhaust camshaft phaser vane plate includes splines engaging the inner shaft of the concentric camshaft.

2. The valve train of claim 1, wherein the exhaust camshaft phaser vane plate includes at least one oil hole; and wherein the concentric camshaft further includes a camshaft bearing structured to provide a path for pressurized lube oil to enter the at least one oil hole.

3. The valve train of claim 1, wherein the intake camshaft phaser vane plate includes a phaser anti-thrust bore pin;

wherein the inner tube of the shaft includes an anti-thrust hole;

wherein the phaser anti-thrust bore pin is structured to engage the anti-thrust hole.

4. The valve train of claim 1, wherein the intake camshaft phaser vane plate includes a discontinuity in the intake splines; and wherein the exhaust camshaft phaser vane plate includes a discontinuity in the exhaust splines.

5. The valve train of claim 1, wherein the concentric camshaft further includes an intake phaser hydraulic cartridge shuttle valve housed within a portion of the inner tube or the shaft extending through the intake camshaft phaser vane plate; and wherein the concentric camshaft further includes an exhaust phaser hydraulic cartridge shuttle valve housed within a portion of the inner tube or the shaft extending through the exhaust camshaft phaser vane plate.

6. The valve train of claim 5, wherein the concentric camshaft further includes an intake phaser hydraulic shuttle valve actuation rod extending within the inner tube between the intake phaser hydraulic cartridge shuttle valve and an intake phaser actuator.

7. The valve train of claim 5, wherein the intake phaser hydraulic cartridge shuttle valve and the exhaust phaser hydraulic cartridge shuttle valve form a chamber there between structured to meter oil to the intake camshaft phaser vane plate and the exhaust camshaft phaser vane plate.

8. The valve train of claim 5, wherein the inner shaft includes advanced and retard drillings for the intake camshaft phaser vane plate; and wherein the outer tube includes advanced and retard slots for the intake camshaft phaser vane plate structured to maintain communication between the intake phaser hydraulic cartridge shuttle valve and the advanced and retard drillings.

9. The valve train of claim 5, wherein the intake phaser hydraulic cartridge shuttle valve is structured to engage the intake camshaft phaser vane plate and the exhaust phaser hydraulic cartridge shuttle valve is structured to engage the exhaust camshaft phaser vane plate to transfer motion from the phaser to the outer tube and the inner shaft.

10. The valve train of claim 1, wherein the concentric camshaft further includes an exhaust lobe having an exhaust lobe connection pin located in a slot of the outer tube; and wherein the concentric camshaft further includes an intake phaser hydraulic cartridge shuttle valve actuation rod within the inner shaft and extending through a hole in the exhaust lobe pin.

11. The valve train of claim 1, wherein the outer tube includes a slot; and further comprising:

an intake camshaft lobe connected to the outer tube;

a dedicated compression release brake lobe connected to the outer tube; and an exhaust camshaft lobe connected to the inner shaft by an exhaust lobe connection pin extending through the slot of the outer tube whereby the exhaust camshaft lobe phases independently of the outer tube.

12. The valve train of claim 11, further comprising:

an intake rocker lever following the intake camshaft lobe;

a dedicated compression release brake rocker following the dedicated compression release brake lobe;

an exhaust rocker lever following the exhaust camshaft lobe.

13. The valve train of claim 11, further comprising:

wherein the exhaust camshaft phaser is structured to control a phase angle of the exhaust camshaft lobe independent of the intake camshaft lobe and the dedicated compression release brake lobe.

14. The valve train of claim 11, wherein the intake camshaft lobe and the dedicated compression release brake lobe are fixed to the outer tube.

15. The valve train of claim 1, further comprising:

an exhaust lobe connection pin connecting the exhaust camshaft lobe to the outer shaft, wherein the outer shaft includes a slot structured to allow the exhaust lobe to phase independently of the outer tube.

16. A valve train, comprising:

a concentric camshaft including:

an outer tube; and an inner shaft extending within the outer tube;

a phaser including:

an intake camshaft phaser vane cavity within the phaser;

an intake camshaft phaser vane plate independently rotatable within the intake camshaft phaser vane cavity;

an exhaust camshaft phase vane cavity within the phaser; and an exhaust camshaft phaser vane plate independently rotatable within the exhaust camshaft phaser vane cavity;

wherein the intake camshaft phaser vane plate includes splines engaging the inner shaft of the concentric camshaft; and wherein the exhaust camshaft phaser vane plate includes splines engaging the outer tube of the concentric camshaft.

17. The valve train of claim 16, wherein the intake camshaft phaser vane plate includes at least one oil hole; and wherein the concentric camshaft further includes a camshaft bearing structured to provide a path for pressurized lube oil to enter the at least one oil hole.

18. The valve train of claim 16, wherein the exhaust camshaft phaser vane plate includes a phaser anti-thrust bore pin;

wherein the inner tube of the shaft includes an anti-thrust hole;

wherein the phaser anti-thrust bore pin is structured to engage the anti-thrust hole.

19. The valve train of claim 16, wherein the intake camshaft phaser vane plate includes a discontinuity in the intake splines; and wherein the exhaust camshaft phaser vane plate includes a discontinuity in the exhaust splines.

20. The valve train of claim 16,

Wherein the concentric camshaft further includes an intake phaser hydraulic cartridge shuttle valve housed within a portion of the inner tube or the shaft extending through the intake camshaft phaser vane plate; and wherein the concentric camshaft further includes an exhaust phaser hydraulic cartridge shuttle valve housed within a portion of the inner tube or the shaft extending through the exhaust camshaft phaser vane plate.

21. The valve train of claim 20, wherein the concentric camshaft further includes an exhaust phaser hydraulic shuttle valve actuation rod extending within the inner tube between the exhaust phaser hydraulic cartridge shuttle valve and an exhaust phaser actuator.

22. The valve train of claim 20, wherein the intake phaser hydraulic cartridge shuttle valve and the exhaust phaser hydraulic cartridge shuttle valve form a chamber there between structured to meter oil to the intake camshaft phaser vane plate and the exhaust camshaft phaser vane plate.

23. The valve train of claim 20, wherein the inner shaft includes advanced and retard drillings for the exhaust camshaft phaser vane plate; and wherein the outer tube includes advanced and retard slots for the exhaust camshaft phaser vane plate structured to maintain communication between the exhaust phaser hydraulic cartridge shuttle valve and the advanced and retard drillings.

24. The valve train of claim 20, wherein the intake phaser hydraulic cartridge shuttle valve is structured to engage the intake camshaft phaser vane plate and the exhaust phaser hydraulic cartridge shuttle valve is structured to engage the exhaust camshaft phaser vane plate to transfer motion from the phaser to the outer tube and the inner shaft.

25. The valve train of claim 16, wherein the concentric camshaft further includes an intake lobe having an intake lobe connection pin located in a slot of the outer tube; and wherein the concentric camshaft further includes an exhaust phaser hydraulic cartridge shuttle valve actuation rod within the inner shaft and extending through a hole in the intake lobe pin.

26. The valve train of claim 16, wherein the outer tube includes a slot; and further comprising:

an intake camshaft lobe connected to the outer tube;

a dedicated compression release brake lobe connected to the outer tube; and an exhaust camshaft lobe connected to the inner shaft by an exhaust lobe connection pin extending through the slot of the outer tube whereby the exhaust camshaft lobe phases independently of the outer tube.

27. The valve train of claim 26, further comprising:

an intake rocker lever following the intake camshaft lobe;

a dedicated compression release brake rocker following the dedicated compression release brake lobe;

an exhaust rocker lever following the exhaust camshaft lobe.

28. The valve train of claim 26, further comprising:

wherein the exhaust camshaft phaser is structured to control a phase angle of the exhaust camshaft lobe independent of the intake camshaft lobe and the dedicated compression release brake lobe.

29. The valve train of claim 26, wherein the intake camshaft lobe and the dedicated compression release brake lobe are fixed to the outer tube.

30. The valve train of claim 26, further comprising:

an exhaust lobe connection pin connecting the exhaust camshaft lobe to the outer shaft, wherein the outer shaft includes a slot structured to allow the exhaust lobe to phase independently of the outer tube.

* * * * *